US009359988B2

(12) United States Patent
McNabb

(10) Patent No.: US 9,359,988 B2
(45) Date of Patent: Jun. 7, 2016

(54) DIRECT CURRENT ELECTRIC STARTER SOLENOID MANUAL ACTIVATION DEVICE

(71) Applicant: Kevin Lloyd McNabb, Roseville, MI (US)

(72) Inventor: Kevin Lloyd McNabb, Roseville, MI (US)

( * ) Notice: Subject to any disclaimer, the term of this patent is extended or adjusted under 35 U.S.C. 154(b) by 462 days.

(21) Appl. No.: 13/864,029

(22) Filed: Apr. 16, 2013

(65) Prior Publication Data

US 2013/0276739 A1 Oct. 24, 2013

Related U.S. Application Data

(60) Provisional application No. 61/635,656, filed on Apr. 19, 2012.

(51) Int. Cl.
*F02N 11/00* (2006.01)
*F02N 11/10* (2006.01)
*F02N 15/06* (2006.01)

(52) U.S. Cl.
CPC ..... *F02N 11/00* (2013.01); *F02N 11/101* (2013.01); *F02N 15/068* (2013.01)

(58) Field of Classification Search
CPC B60R 25/02142; B60R 25/04; B60R 25/042; F02N 11/00; F02N 11/087; F02N 11/0851; F02N 11/10; F02N 11/101; F02N 15/04; F02N 5/02; F02N 15/10; F02N 99/00; Y10T 137/7225; Y10T 137/7131; Y10T 70/5965; A01D 34/6818; A01D 34/824; A01D 34/828; A01D 34/78; E05B 47/0004; E05B 81/08; F04B 49/02; F16K 35/06
USPC ..... 123/366, 406.53, 406.54, 406.76, 685, 123/491, 149 B, 179.1, 179.3, 179.24, 123/179.31, 179.25, 185.1, 185.14, 185.3, 123/185.4, 185.5, 185.6, 185.8, 185.9, 123/185.11, 185.12, 179.16, 198 D, 185.7; 477/99; 56/10.5; 290/10, 18, 22, 27, 290/28, 31, 36 R, 36 A, 38 R, 38 A, 38 C, 46, 290/47, 48
See application file for complete search history.

(56) References Cited

U.S. PATENT DOCUMENTS 1,718,424 A * 6/1929 McGrath ..... F02N 5/04 123/179.22
1,931,459 A * 10/1933 Lansing ..... F02N 19/001 74/7 R
2,064,350 A * 12/1936 Maurer ..... F02N 11/08 290/37 R
2,322,154 A * 6/1943 Nardone ..... F02N 5/04 123/179.22
2,346,149 A * 4/1944 Brewer ..... B60K 23/02 180/279
2,939,444 A * 6/1960 Leibing ..... F02M 3/045 123/333
3,153,943 A * 10/1964 Strauss ..... 477/121
3,447,523 A * 6/1969 Bradbury ..... F02N 5/02 123/185.14
3,668,410 A * 6/1972 Ballandras ..... F02P 19/02 290/38 R (Continued)

*Primary Examiner* — Hung Q Nguyen
*Assistant Examiner* — John Bailey
(74) *Attorney, Agent, or Firm* — Dunlap, Bennett & Ludwig PLLC

(57) ABSTRACT

A manual activation device for activating a starter assembly. The present invention may include a push rod that is connected to a solenoid plunger. The starter may be activated manually by pushing the rod and thereby pushing the solenoid plunger into the gears. Therefore, if there is an electrical or mechanical malfunction with the starter or the vehicle, the push rod may be pushed in to start the vehicle.

4 Claims, 2 Drawing Sheets

(56) References Cited

U.S. PATENT DOCUMENTS 3,670,836 A * 6/1972 Tonkowich ..... B60R 25/042 137/384.4
3,747,378 A * 7/1973 Hiatt ..... B60R 25/042 137/384.4
3,776,263 A * 12/1973 Hubenthal ..... B60R 25/042 137/354
3,782,493 A * 1/1974 Lipschutz ..... B60R 25/02142 123/198 B
3,838,587 A * 10/1974 Good ..... B60R 25/042 137/353
3,958,398 A * 5/1976 Fuelling, Jr. ..... A01D 34/6818 477/99
3,971,353 A * 7/1976 Harkness ..... A01D 34/6818 477/99
4,117,821 A * 10/1978 Kawai ..... F02N 11/0851 123/179.16
4,169,447 A * 10/1979 Furzer ..... F02N 11/00 123/179.19
4,502,429 A * 3/1985 Ebihara ..... F02N 11/00 123/179.22
4,668,874 A * 5/1987 Cresap ..... B60R 25/045 180/287
4,787,223 A * 11/1988 Gotanda ..... B60R 25/04 292/216
4,906,857 A * 3/1990 Cummins ..... F02N 11/0851 290/38 R
4,909,199 A * 3/1990 Kurozu ..... B60R 25/02142 123/146.5 B
4,916,327 A * 4/1990 Cummins ..... F02N 11/0851 290/38 R
4,917,410 A * 4/1990 Cummins ..... F02N 11/087 290/38 R
4,917,411 A * 4/1990 Cummins ..... F02N 11/087 290/38 R
5,092,147 A * 3/1992 Mochida ..... B60R 25/02142 70/252
5,345,901 A * 9/1994 Siegenthaler ..... F02N 11/10 123/179.3
5,738,058 A * 4/1998 Gotto ..... F02N 3/02 123/146.5 B
5,934,313 A * 8/1999 Brothers ..... B60R 25/042 137/351
6,230,678 B1 * 5/2001 Gracyalny ..... F02N 15/022 123/185.14
6,311,663 B2 * 11/2001 Gracyalny ..... 123/185.14
6,789,520 B2 * 9/2004 Saito ..... F02N 11/105 123/179.3
7,140,339 B1 * 11/2006 Smith ..... F02N 11/0803 123/179.24
7,574,988 B1 * 8/2009 Fiorenza ..... F02N 7/08 123/179.31
7,665,438 B2 * 2/2010 Hirning ..... F02N 11/0855 123/179.3
7,886,706 B2 * 2/2011 Grybush ..... B60R 25/04 123/179.24
2001/0006051 A1 * 7/2001 Gracyalny ..... F02N 5/02 123/185.14
2005/0183480 A1 * 8/2005 Hingston ..... E05B 47/0002 70/279.1
2005/0268876 A1 * 12/2005 Liu ..... F02N 3/02 123/185.3
2006/0053913 A1 * 3/2006 Sinn ..... F02N 15/10 74/6
2008/0281505 A1 * 11/2008 Hata ..... B60R 25/02113 701/113
2010/0059007 A1 * 3/2010 Senda ..... F02N 11/0844 123/179.4
2013/0027157 A1 * 1/2013 Niimi ..... H01H 50/443 335/2
2013/0111864 A1 * 5/2013 Hansen ..... B60R 7/042 56/10.8
2013/0111865 A1 * 5/2013 Hansen ..... F02N 11/0803 56/11.3

* cited by examiner

DIRECT CURRENT ELECTRIC STARTER SOLENOID MANUAL ACTIVATION DEVICE

BACKGROUND OF THE INVENTION

The present invention relates to a manual starter activation device and, more particularly, to a push rod that is connected to a solenoid plunger to manually activate the starter.

The modern starter motor is either a permanent-magnet or a series-parallel wound direct current electric motor with a starter solenoid (similar to a relay) mounted on it. When current from the starting battery is applied to the solenoid, usually through a key-operated switch, the solenoid engages a lever that pushes out the drive pinion on the starter drive-shaft and meshes the pinion with the starter ring gear on the flywheel of the engine. However, when the battery on the vehicle is dead or there is some other starter malfunction, it may very difficult to activate the starter motor.

As can be seen, there is a need for a device for manually activating the starter motor.

SUMMARY OF THE INVENTION

In one aspect of the present invention, a device for manually activating a starter comprises: a push rod having a first end and a second end, wherein the first end is configured to be accessed by a user and the second end of the push rod is connected a solenoid plunger of a starter assembly, wherein the push rod is in an engaged position and a disengaged position, the engaged position comprising the push rod pushed inward towards the starter assembly and thereby engaging the solenoid plunger to activate the starter assembly, and the disengaged position comprising the push rod pulled away from the starter assembly and thereby the solenoid plunger is not activating the starter assembly.

These and other features, aspects and advantages of the present invention will become better understood with reference to the following drawings, description and claims.

DETAILED DESCRIPTION OF THE INVENTION

Figure 1:
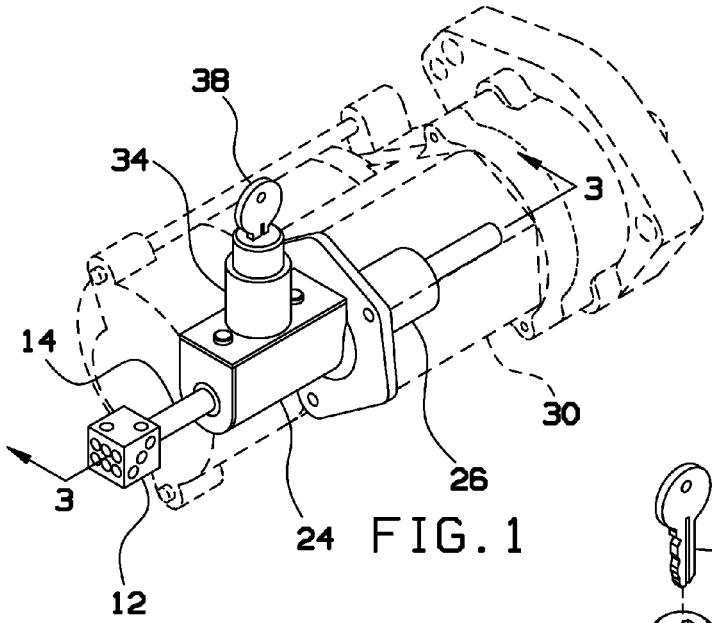
FIG. 1 is a perspective view of the present invention shown in use.
Figure 2:
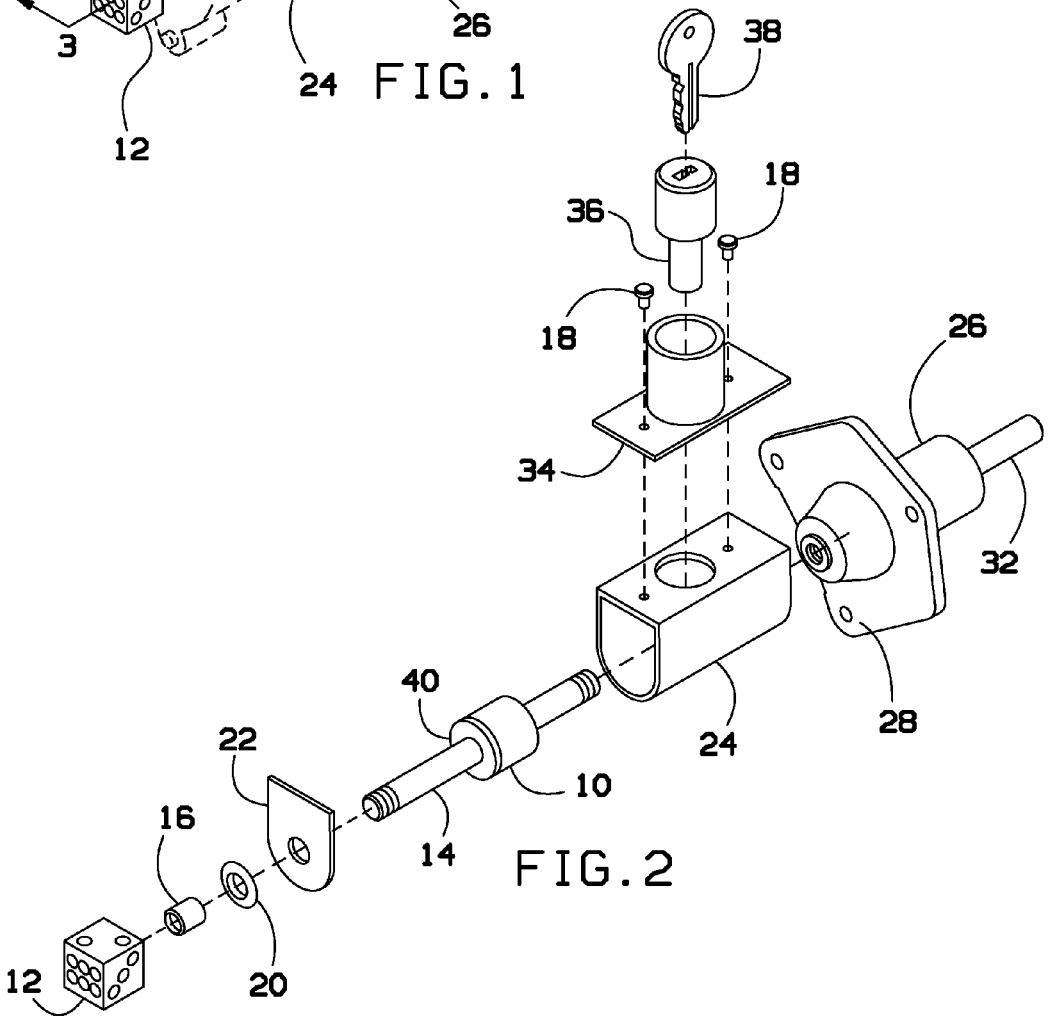
FIG. 2 is an exploded perspective view of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a manual activation device for activating a starter assembly. The present invention may include a push rod that is connected to a solenoid plunger. The starter may be activated manually by pushing the rod and thereby pushing the solenoid plunger into the gears. Therefore, if there is an electrical or mechanical malfunction with the starter or the vehicle, the push rod may be pushed in to start the vehicle.

The present invention may allow for manual engagement of a D/C starter solenoid on a combustion engine when the starter fails due to mechanical or electrical failure. The present invention may further disengage if the solenoid is stuck in a contact position to prevent a potential electrical fire. Alternatively, the present invention may further protect from theft and may also serve as a diagnostic tool.

If the starter does not electronically engage in a combustion engine, the present invention may manually engage the starter by pushing a rod inward. If the starter sticks, the rod may be pulled out to manually disengage and prevent an electrical fire. In certain embodiments, a lock button may be pushed down to lock the starter, which may prevent the starter from engaging. This may prevent theft. Further, the present invention may be used as a diagnostic tool to determine if it is a bad starter or there is another electrical issue.

Referring to FIGS. 1 through 4 the present invention may include a device that may be secured to a starter motor 30. The device may include a rod 14 that may be attached to a solenoid plunger 32. The rod 14 may allow a user to manually engage a starter solenoid 26 to start an engine of a vehicle. Further, the rod 14 may allow a user to disengage the solenoid plunger 30 from the starter solenoid 26 to prevent electrical fires.

The solenoid plunger 32 may fit within the starter solenoid 26. The solenoid plunger 32 may include a front end, a middle portion and a back end. The middle portion may be within the solenoid 26 and the back end may protrude from the solenoid 26 and engage the gears to start the engine. The rod 14 may include a first end and a second end. The front end of the solenoid plunger 32 may attach to the second end of the rod 14. For example, the front end of the solenoid plunger 32 may include a threaded portion that receives the second end which may include a threaded portion, and thereby secures the rod 14 to the solenoid plunger 32.

In certain embodiments, the present invention may include a solenoid cap 28. The solenoid cap 28 may be secured to the starter assembly 30. The solenoid cap 30 may include a solenoid cap housing which is configured to receive and house the front end of the solenoid plunger 32 in a disengaged configuration. The solenoid cap 28 may prevent the plunger 32 from being removed from the starter assembly 30.

Figure 3:
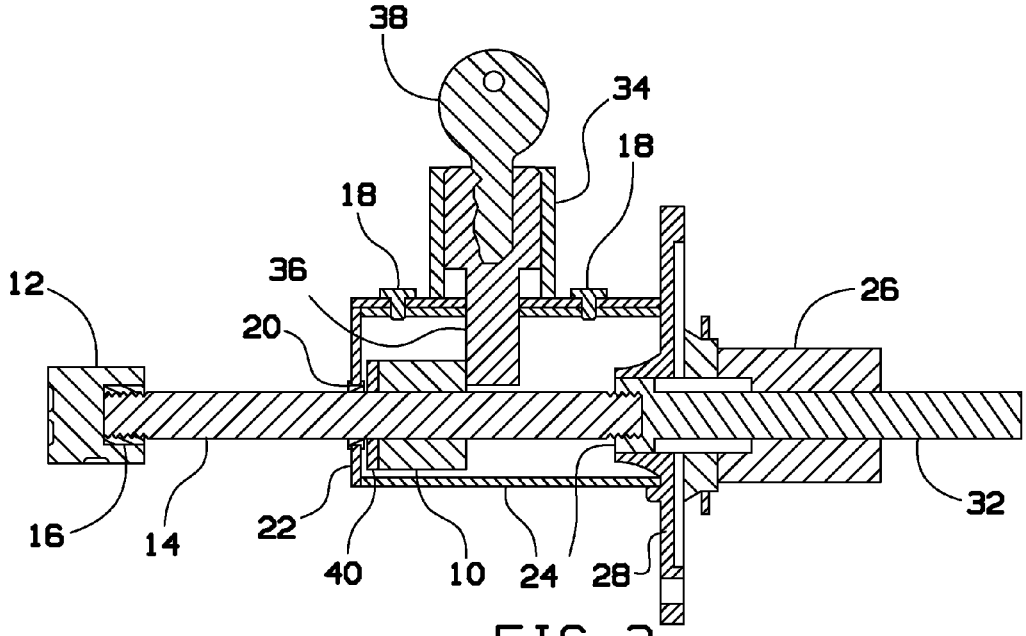
FIG. 3 is a detailed section view of the present invention taken along line 3-3 in FIG. 1.
Figure 4:
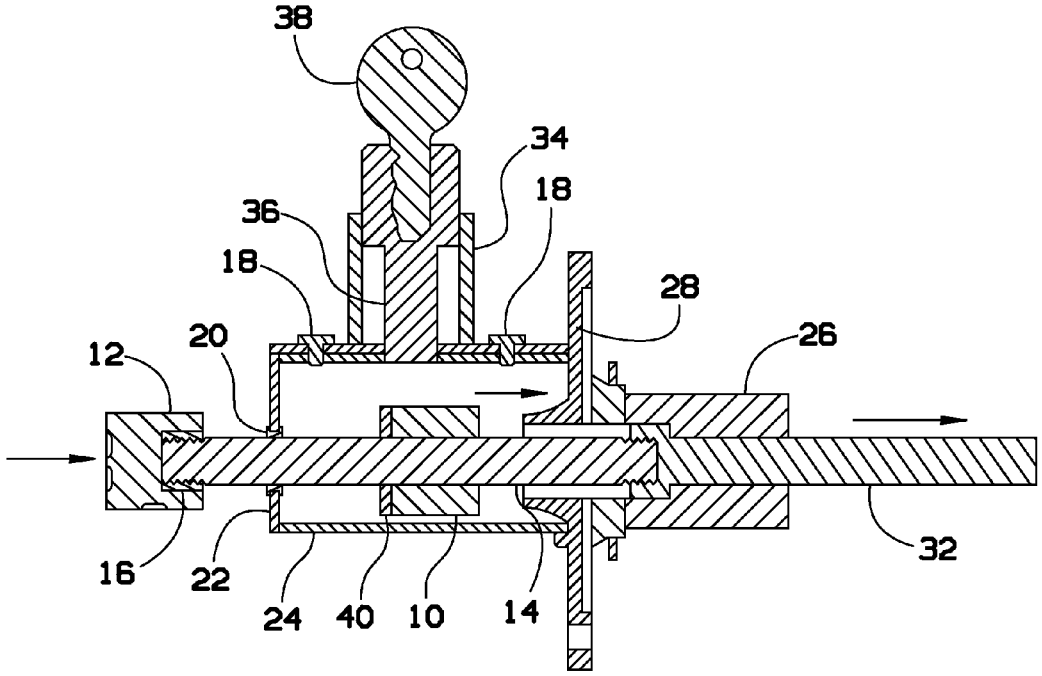
FIG. 4 is a detailed section view of the present invention showing the push rod and the solenoid plunger of FIG. 3 being pressed.

As illustrated in FIGS. 3 and 4, the present invention may be in an engaged configuration and a disengaged configuration. As illustrated in FIG. 4, the engaged configuration may include the rod pushed inward towards the solenoid 26, and thereby pushing the solenoid plunger into the starter assembly. The plunger 32 may thereby engage the gears and start the engine without the use of electricity. As illustrated in FIG. 3, the disengaged configuration may include the front end of the plunger 32 within the housing of the solenoid cap 28. The disengaged configuration may be for when the user is not using the present invention. Alternatively, the rod 14 may be pulled from the engaged position into the disengaged position. Therefore, once the plunger 32 has engaged the gears to start the car, the plunger 32 may be disengaged to prevent an electrical fire.

In certain embodiments, the present invention may include a locking mechanism. The locking mechanism may be used to prevent theft. For example, the locking mechanism, when locked, may prevent a user from engaging the solenoid plunger 32. In certain embodiments, this may be done by preventing a user from pushing the rod 14 inward. The locking mechanism may include a housing 24 that houses a portion of the rod 14. In certain embodiments, the housing 24 may be connected to the solenoid cap 28. The housing 24 may include a front plate 22. The front plate 22 may include an opening with a rod grommet 20 that facilitates easy back and forth movement of the rod 14, and prevents outside contaminants from entering the housing 24. As illustrated in FIG. 3, a lock stop 10, such as a nylon lock stop, may be attached to the rod 14. The lock stop 10 may be attached to the rod 14 at the portion of the rod 14 that is within the housing 24. The lock stop 10 may be fixed to the rod 14 by a lock stop washer 40.

The locking mechanism may further include a lock 34 that may be secured to the housing 24 by rivets 18. The lock 34 and the housing 24 may both include openings which may be aligned with one another. A lock cylinder 36 may be configured to fit within the openings. As illustrated in FIGS. 3 and 4, in a locked position the lock cylinder may protrude within the housing 24 and may secure the lock stop 10 between the housing front plate 22 and the lock stop 10. This may prevent the rod 14 from being pushed inward, and thereby prevent an unwanted user from activating the device. A key 38 may be inserted into the locking mechanism and unlocked. In the unlocked position, the lock cylinder 36 may be removed from the inside of the housing and may thereby allow the lock stop 10 and the rod 14 to be pushed forward, which may activate the starter 30.

The present invention may further include a knob 12. The knob 12 may be used to control the rod 14 by pushing the knob 12 forward to engage the solenoid and to pull the knob 12 backward to disengage the solenoid. The knob 12 may be attached to the first end of the rod 14. In certain embodiments, the first end of the rod 14 may be threaded. The knob 12 may include a knob bushing 16. The knob bushing 16 may be screwed onto the first end of the rod 14 and thereby may be secured to the rod 14.

The following may include a method of making the present invention. The plunger and cap may be drilled to create openings to fit the push rod. The push rod may be cut to an appropriate length and may be thread on both ends. The nylon lock stop may be cut to an appropriate size with holes drilled in the center for the push rod. A brass knob bushing may be cut to length. A hole may be drilled and threaded for the knob to screw onto the rod. The rod grommet may be installed on the housing. The housing may be aluminum die casted or metal stamped, and the mounting holes lock holes and rod hole may be drilled in. The lock pop rivet may be used to connect the lock to the housing.

The following may include a method of using the present invention. By turning a key to start the position and or hitting the starter button, the starter may not engage or the engine does not turn over due to electrical or mechanical failure. Using the present invention, a person may manually engage the starter by manually pushing the rod in. This would allow the starter to start the engine. If the starter or solenoid sticks in the contact position, an electric fire may start. In this case a person may pull the rod out to the disengaged position. This would create a break in the contact. By pushing down on the lock button when not in use the present invention may be locked, which prevents the starter from making electrical connection, and thereby preventing theft.

It should be understood, of course, that the foregoing relates to exemplary embodiments of the invention and that modifications may be made without departing from the spirit and scope of the invention as set forth in the following claims.

What is claimed is:

1. A device for manually activating a starter comprising:

a housing comprising a first side and a second side, wherein the first side comprises a first panel comprising a first opening;

a push rod slidably engaged with the first opening and having a first end and a second end, wherein the first end is configured to be accessed by a user and the second end of the push rod is connected to a solenoid plunger of a starter assembly, a solenoid cap comprising a first side attached to the second side of the housing and a second side configured to be secured to a starter assembly, wherein the solenoid cap comprises a second opening aligned with the first opening, wherein the solenoid plunger slidably engages with the second opening;

a lock stop fixed to a portion of the push rod that is within the housing and in between the first end and the second end;

a lock comprising a lock cylinder operatively attached to the housing, wherein the push rod comprises an engaged position and a disengaged position, the engaged position comprising the push rod pushed inward towards the starter assembly and thereby engaging the solenoid plunger to activate the starter assembly, and the disengaged position comprising the push rod pulled away from the starter assembly and thereby the solenoid plunger is not activating the starter assembly, wherein the lock is in a locked position and an unlocked position, the locked position comprising the lock cylinder protruding within the housing, and securing the lock stop between the front panel and the lock cylinder preventing the push rod from slidably engaging the first opening, and the unlocked position comprising the lock cylinder at least partially removed from the housing.

2. The device of claim 1, wherein the second end of the push rod is threaded and an end of the solenoid plunger comprises a threaded receiver configured to receive and secure the second end of the push rod.

3. The device of claim 1, wherein the solenoid cap comprises a housing, wherein an end of the solenoid plunger is housed in the disengaged position.

4. The device of claim 1, further comprising a knob attached to the first end of the push rod.

* * * * *